US008425345B2

(12) United States Patent
Wall, Jr. et al.

(10) Patent No.: US 8,425,345 B2
(45) Date of Patent: Apr. 23, 2013

(54) VARIABLE LENGTH SHAFT

(75) Inventors: Broadus Perry Wall, Jr., Carlsbad, CA (US); Tim Goudarzi, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 301 days.

(21) Appl. No.: 13/009,710

(22) Filed: Jan. 19, 2011

(65) Prior Publication Data

US 2012/0149489 A1 Jun. 14, 2012

Related U.S. Application Data

(60) Provisional application No. 61/422,982, filed on Dec. 14, 2010.

(51) Int. Cl.
*A63B 53/16* (2006.01)

(52) U.S. Cl.
USPC ..... 473/296; 473/299; 473/288; 403/349

(58) Field of Classification Search ..... 473/296, 473/239, 294, 297, 299, 298, 307, 305, 288; 403/349
See application file for complete search history.

(56) References Cited

U.S. PATENT DOCUMENTS 1,309,375 A * 7/1919 Taylor ..... 248/413
1,623,523 A * 4/1927 Bourke ..... 473/307
2,464,850 A 3/1949 Crawshaw
3,604,734 A * 9/1971 Friedman et al. ..... 403/104
4,010,958 A 3/1977 Long
4,340,227 A 7/1982 Dopkowski
4,415,156 A 11/1983 Jorgensen
4,597,577 A * 7/1986 Lamanna ..... 473/307
4,688,798 A 8/1987 Pelz
4,793,616 A 12/1988 Fernandez
5,294,118 A 3/1994 Iwanaga
5,470,068 A 11/1995 Schmidt et al.
5,632,691 A 5/1997 Hannon et al.
5,716,289 A * 2/1998 Okoneski ..... 473/297
5,951,412 A 9/1999 Rose et al.
5,997,412 A 12/1999 Benson
6,086,484 A 7/2000 Uebelhor
6,213,890 B1 * 4/2001 Prince ..... 473/292
6,343,999 B1 2/2002 Murtland et al.
6,375,583 B1 4/2002 Solheim
6,547,673 B2 * 4/2003 Roark ..... 473/239
6,780,120 B2 * 8/2004 Murray ..... 473/239

(Continued)

OTHER PUBLICATIONS

Acculength Junior Golf Innovation "The Only Clubs that Grow with Kids" website www.acculength.com/page/332-17104.htm 3 pages, Feb. 19, 2013.*

(Continued)

*Primary Examiner* — Stephen L. Blau
(74) *Attorney, Agent, or Firm* — Rebecca Hanovice; Michael A. Catania; Sonia Lari

(57) ABSTRACT

A variable length golf club shaft is disclosed herein. The variable length golf club shaft includes at least one upper shaft portion having a first diameter and a hollow lower shaft portion having a second diameter that is larger than the first diameter, wherein the lower shaft portion has at least one notch, and wherein the at least one upper shaft portion has at least one pin that fits within the at least one notch.

14 Claims, 6 Drawing Sheets

U.S. PATENT DOCUMENTS

| | | | | |
|---|---|---|---|---|
| 6,796,911 | B2 | 9/2004 | Grace | |
| 6,932,711 | B2 | 8/2005 | Benson | |
| RE38,983 | E | 2/2006 | Antonious | |
| 7,018,302 | B2 * | 3/2006 | Jacoby | 473/294 |
| 7,195,565 | B2 * | 3/2007 | White et al. | 473/296 |
| 7,510,482 | B2 | 3/2009 | Benson | |
| 7,563,173 | B2 | 7/2009 | Chol | |
| 7,582,023 | B2 * | 9/2009 | Hung | 473/299 |
| 7,704,161 | B2 * | 4/2010 | Lindner | 473/297 |
| 7,874,932 | B2 | 1/2011 | Chol | |
| 8,182,361 | B2 * | 5/2012 | Gill | 473/299 |
| 2001/0005696 | A1 | 6/2001 | Hedrick | |
| 2004/0102255 | A1 | 5/2004 | Benson | |
| 2004/0116197 | A1 * | 6/2004 | Benson | 473/239 |
| 2005/0143186 | A1 * | 6/2005 | Blattner et al. | 473/296 |
| 2008/0081708 | A1 * | 4/2008 | Wilmsen et al. | 473/297 |
| 2009/0270197 | A1 * | 10/2009 | Holtzman | 473/296 |
| 2010/0081515 | A1 * | 4/2010 | White et al. | 473/296 |
| 2010/0304881 | A1 | 12/2010 | Chol | |
| 2011/0034264 | A1 * | 2/2011 | Mitsumoto | 473/282 |
| 2011/0081984 | A1 | 4/2011 | Beach et al. | |
| 2011/0159982 | A1 | 6/2011 | Takeuchi | |

OTHER PUBLICATIONS

Acculength Junior Golf Innovation www.acculength.com/page/332-17104.htm, 3 pages, Feb. 19, 2013.

* cited by examiner

VARIABLE LENGTH SHAFT

CROSS REFERENCES TO RELATED APPLICATIONS

The present application claims priority to U.S. Provisional Patent Application No. 61/422,982, filed on Dec. 14, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a variable length shaft assembly that allows for quick, semi-permanent length adjustments. More specifically, the present invention relates to a variable length shaft whose length can be adjusted in a short period of time with the use of components having different lengths.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves damage to or destruction and removal of the grip on a shaft. Upon removal of the grip by tearing or peeling, the end portion of the shaft can be trimmed or otherwise cut to decrease the club length, or an extension piece can be affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the shaft and the grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive method than is currently available.

BRIEF SUMMARY OF THE INVENTION

One aspect of the present invention is a variable length golf club shaft comprising at least one upper shaft portion having a first diameter and a hollow lower shaft portion having a second diameter that is larger than the first diameter, wherein the lower shaft portion has at least one notch, and wherein the at least one upper shaft portion has at least one pin that fits within the at least one notch. The golf club shaft may further comprise a locating clip, which may comprise a circular portion and at least one prong that fits within the at least one notch and which may be made of a metal material. The locating clip may further comprise two prongs.

The notch of the variable length golf club shaft may have at least one side channel sized to hold the at least one pin. In a further embodiment, the lower shaft portion may have two notches, each of which may have at least one side channel sized to hold the at least one pin. The upper shaft portion may further have two pins that can fit within the two notches.

The variable length golf club shaft of the present invention may comprise two or more upper shaft portions having different lengths, and may comprise at least one upper grip portion fitted to each of the two or more upper shaft portions having different lengths. In a further embodiment of the present invention, the variable length golf club shaft comprises an upper grip portion and a lower grip portion, wherein the upper grip portion is fitted over at least a portion of the upper shaft portion and the lower grip portion is fitted over at least a portion of the lower shaft portion. The upper grip portion may be affixed to the upper shaft portion with a bolt.

In another embodiment of the variable length golf club shaft, an expandable bushing may be affixed to the at least one upper shaft portion. The at least one upper portion may have a hollow section which can hold a weighting member.

Another aspect of the present invention is a variable length golf club shaft comprising an upper shaft portion having a first diameter and at least one pin and a hollow lower shaft portion having a notch and a second diameter that is larger than the first diameter, wherein the notch has two or more side channels spaced longitudinally apart from each other and sized to hold the at least one pin. This embodiment may further comprise a locating clip and an expandable bushing affixed to the upper shaft portion, wherein the expandable bushing is composed of a urethane.

DETAILED DESCRIPTION OF THE INVENTION

Figure 1:
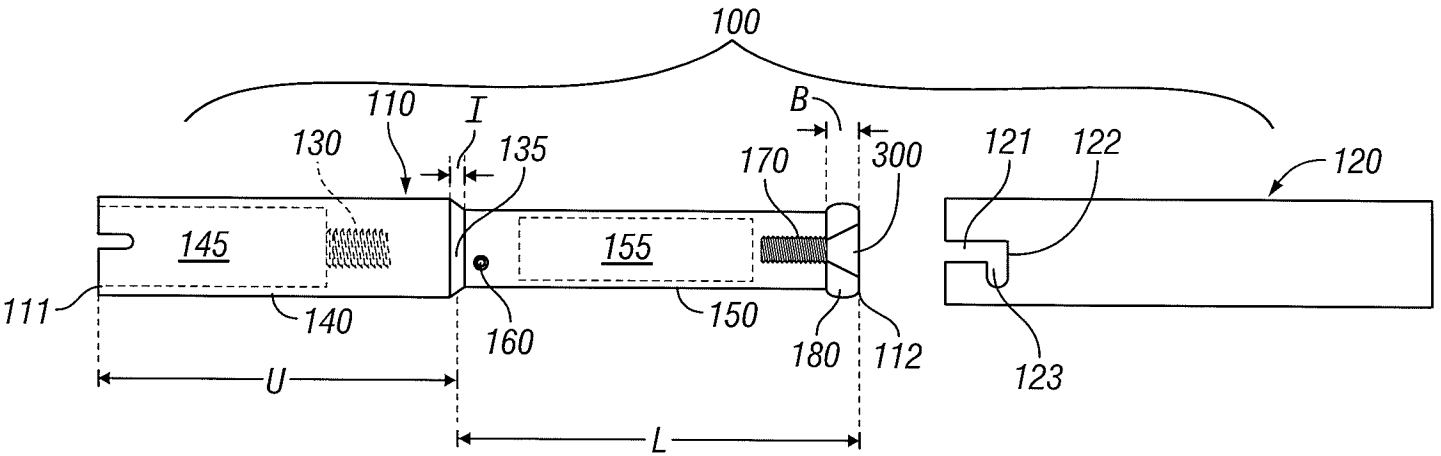
FIG. 1 is a side plan view of an unassembled first embodiment of the variable length shaft of the present invention.

The present invention is directed to a variable length shaft and grip that provides club length adjustability. Club length adjustability is an advantageous feature for golf clubs, because, for example, extending the length of a club can have the desired effect of increasing club head speed, which results in longer driving distances. Conversely, shortening the length of a club would provide a golfer with more control and accuracy in driving the golf ball. Golf course conditions often require accurate driving due to hazards, including but not limited to water, rough, sand, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's length to help improve accuracy, distance, and feel as needed or desired.

The present invention provides golfers with a system and method to easily, quickly and inexpensively modify the length of their golf clubs to have them perform in a desired manner. This invention will enable golfers to change their club length wherever they wish, including, but not limited to, at the practice range, the golf course, and their home. The present invention also is designed to avoid altering a club's swing weight or its "feel." The components used to alter a club's length in the present invention are small and can be carried in a pocket of the user's golf bag. Furthermore, the technical ability required to modify the golf club length according to this invention is minimal and its approach is intuitive and easy for a golfer to understand.

FIGS. 1-9 show a preferred embodiment of the present invention. This embodiment comprises a two-part shaft 100 having upper 110 and lower 120 sections, a two-part grip 200 having upper 210 and lower 220 sections, and a locating clip 400 to secure the upper shaft section 110 to the lower shaft section 120. In this embodiment, a user can remove the upper shaft and grip sections 110, 210 from the lower shaft and grip section 120, 220 and replace them with upper shaft and grip sections 110, 210 having different overall lengths and/or weights.

Figure 3:
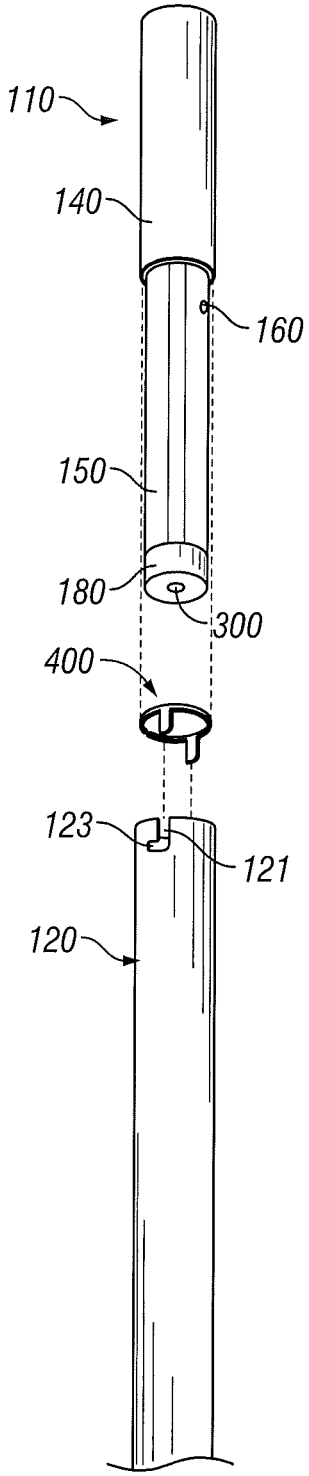
FIG. 3 is a side plan view of the variable length shaft shown in FIG. 1
Figure 4:
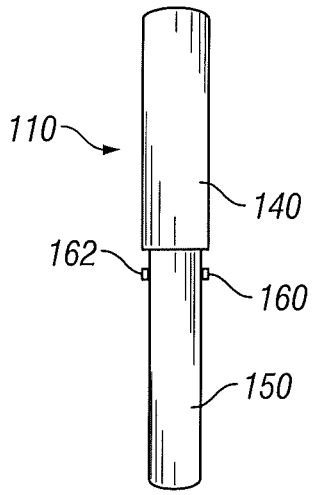
FIG. 4 is a side plan view of an upper shaft portion of the embodiment shown in FIG. 3.

As shown in FIGS. 1, 3, and 4, the upper shaft 110, which has proximal 111 and distal ends 112 and proximal and distal portions 140, 150, includes a threaded hole 130 located in the proximal portion 140. As shown in FIG. 1, the threaded hole 130 extends from a hollow interior portion 145 located in the proximal portion 140 of the upper shaft 110 toward the distal portion 150. In an alternative embodiment, the threaded hole 130 may extend from the furthest extent of the proximal end 111 toward the distal portion 150. One or more weights (not shown) may optionally be placed in the hollow interior 145 of the proximal portion 140 to affect swing balance.

As shown in FIG. 1, the proximal portion 140 of the upper shaft 110 has a length "U." In the preferred embodiment, a user can separate the upper shaft 110 from the lower shaft 120 and replace the upper shaft 110 with another upper shaft piece having a different "U" length. In this way, a user can change the overall length of the shaft 100 without changing the lower shaft 120, i.e, without having to handle a golf club head (not shown). The proximal and distal portions 140, 150 of the upper shaft 110 are separated by an intermediate portion 135, which, in the preferred embodiment, has a length "I" of approximately 0.125 inches. The length I remains the same across varying lengths of upper shaft pieces in the preferred embodiment, but in an alternative embodiment this length I may vary depending on the upper shaft 110 selected.

As shown in FIGS. 1, 3, and 4, the distal portion 150 of the upper shaft 110 includes at least one protruding pin 160, which has a diameter of 0.080 inches, and also comprises a hollow interior portion 155, which can optionally hold weights (not shown) or be left empty to reduce the overall weight of the shaft 100. In the preferred embodiment, the upper shaft 1100 has two protruding pins 160, 162, shown in FIG. 4, each of which has a diameter of approximately 0.080 inches. In the preferred embodiment, the distal portion 150 has a length "L" of approximately 2.250 inches, but in other embodiments this length may vary depending on the upper shaft 110 selected by the user.

As shown in FIG. 1, in the preferred embodiment the distal portion 150 further includes a threaded bore 170 originating at the distal end 112 of the upper shaft 110, and an expandable bushing 180 having a through hole is affixed to the distal end 112 with a bolt 300. See also FIGS. 3 and 7. The expandable bushing 180 may, in alternative embodiments, be affixed to the distal end 112 using adhesives or other methods. The expandable bushing 180 preferably is composed of a polymer, particularly 65 Shore D urethane, and has a length "B" of approximately 0.250 inches. In other embodiments, the expandable bushing 180 is composed of neoprene or plastic. The expandable bushing 180 helps to secure, via friction, the upper shaft 110 to the lower shaft 120 when the upper and lower shaft pieces 110, 120 are assembled as disclosed herein.

Figure 5:
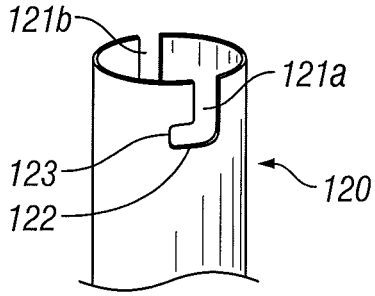
FIG. 5 is an enlarged, side perspective view of part of the lower shaft portion of the embodiment shown in FIG. 3.
Figure 6:
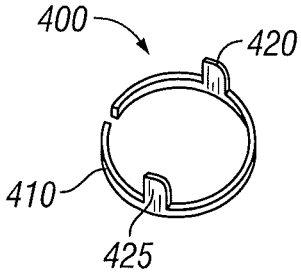
FIG. 6 is a side perspective view of the locating clip shown in FIG. 3.
Figure 7:
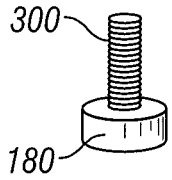
FIG. 7 is a side perspective view of the expandable bushing shown in FIG. 3.

As shown in FIGS. 1, 3, and 5, the lower shaft 120 comprises at least one notch 121. In the preferred embodiment shown in FIG. 5, the lower shaft 120 comprises two notches 121*a*, 121*b*, to receive the two pins 160, 162. The lower shaft 120 is hollow and has a diameter that is greater than the diameter of the distal portion 150 of the upper shaft 110. To assemble the upper shaft 110 with the lower shaft 120, the distal portion 150 of the upper shaft 110 is inserted into the hollow interior of the lower shaft 120 and is oriented such that the pins 160, 162 slide into the notches 121*a*, 121*b*. Once the pins 160, 162 come into contact with the ends 122, (not shown) the notches 121*a*, 121*b*, the upper shaft 110 is twisted such that the pins 160, 162 are engaged by side channels 123, (not shown) of the notches 121*a*, 121*b*.

Figure 8:
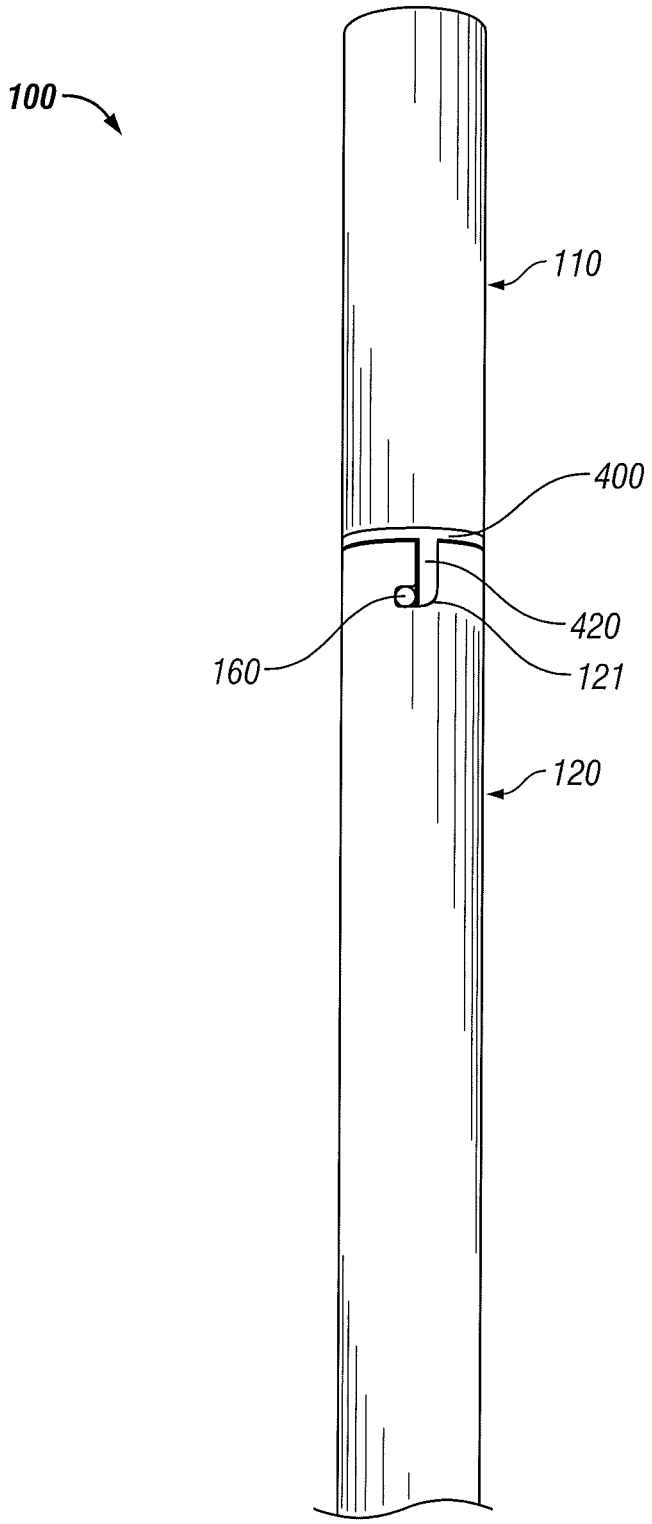
FIG. 8 is a side plan view of the embodiment shown in FIG. 3 in assembled form.

Once the upper and lower shaft pieces 110, 120 are assembled as described above, the locating clip 400, shown in FIGS. 3 and 6, is applied to secure the pieces. The locating clip 400 comprises a circular piece of material 410, preferably metal, and more preferably titanium alloy, which has at least one prong 420 extending perpendicularly away from the circular portion 410. In the preferred embodiment, the locating clip has two prongs 420, 425. The locating clip 400 is slid over the proximate end 110 of the upper shaft piece 110, and the prongs 420, 425 are fitted into the notches 121*a*, 121*b* to prevent the pins 160, 162 from moving out of the side channels 123, (not shown) and back into the notches 121*a*, 121*b*. FIG. 8 shows the upper and lower shaft pieces 110, 120 in fully assembled form with the locating clip 400 in place.

Figure 2:
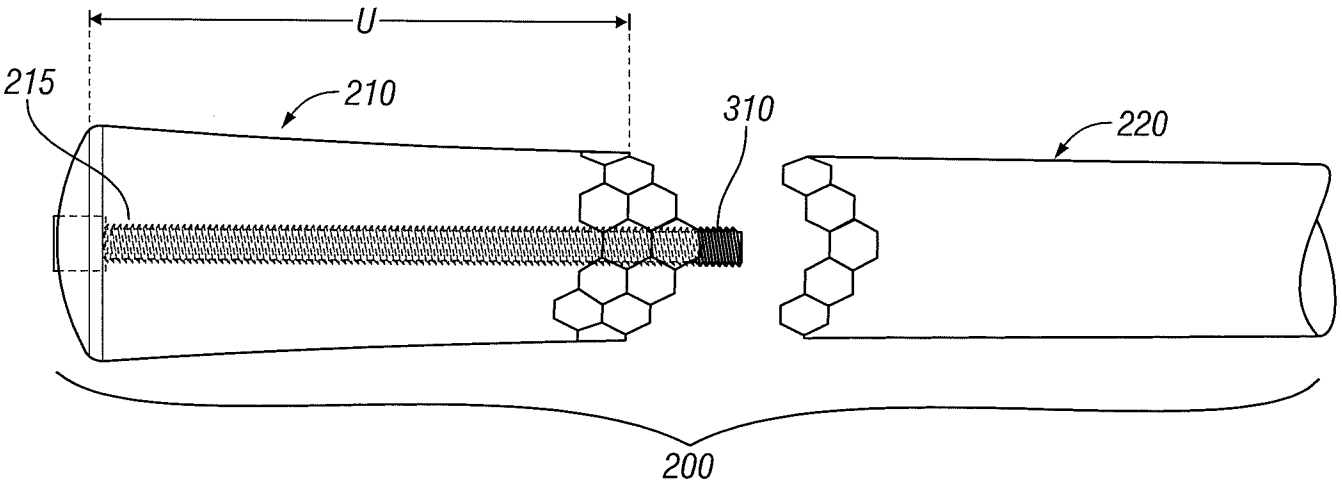
FIG. 2 is a side plan view of a grip to be used with the variable length shaft shown in FIG. 1
Figure 9:
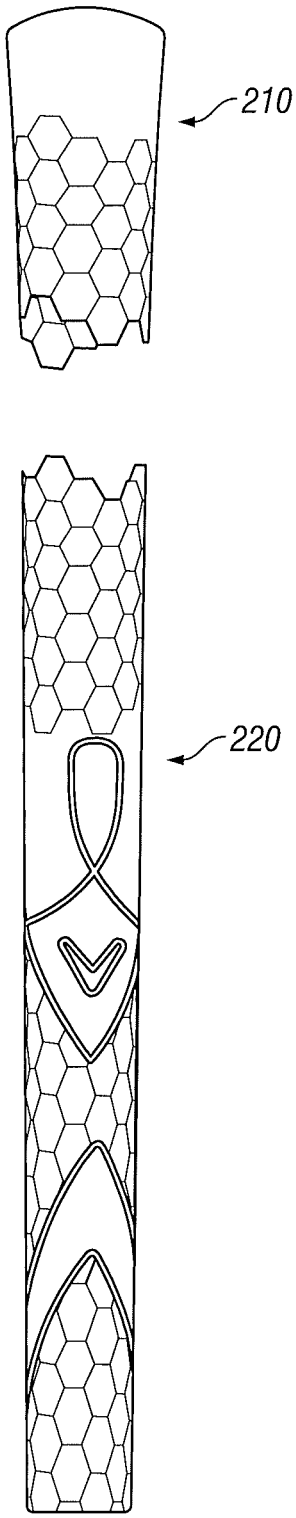
FIG. 9 is a side perspective view of the grip shown in FIG. 2.

The grip pieces 210, 220 of the present invention are shown in FIGS. 2 and 9. As shown in FIG. 2, the upper grip 210 includes a hole 215 that spans the length "U" of the upper grip 210 and receives a bolt 310. The upper grip 210 is installed on the upper shaft 110 by sliding the upper grip 210 over the upper shaft 110 so that the upper grip 210 encircles at least the upper portion 140, inserting the bolt 310 into the upper grip hole 215 and engaging the bolt 310 with the threads of the upper shaft hole 130. Tightening the bolt 310 removably secures the upper grip 210 to the upper shaft 110 and holds the locating clip 400 in place. When the bolt 310 is removed, the upper grip section 210 can be removed from the upper shaft section 110. The lower grip 220 is installed on the lower shaft 120 using double sided tape or another type of adhesive. Alternatively, in another embodiment, the upper grip 210 is affixed to the upper shaft portion 110 with double sided tape or adhesive.

Figure 10:
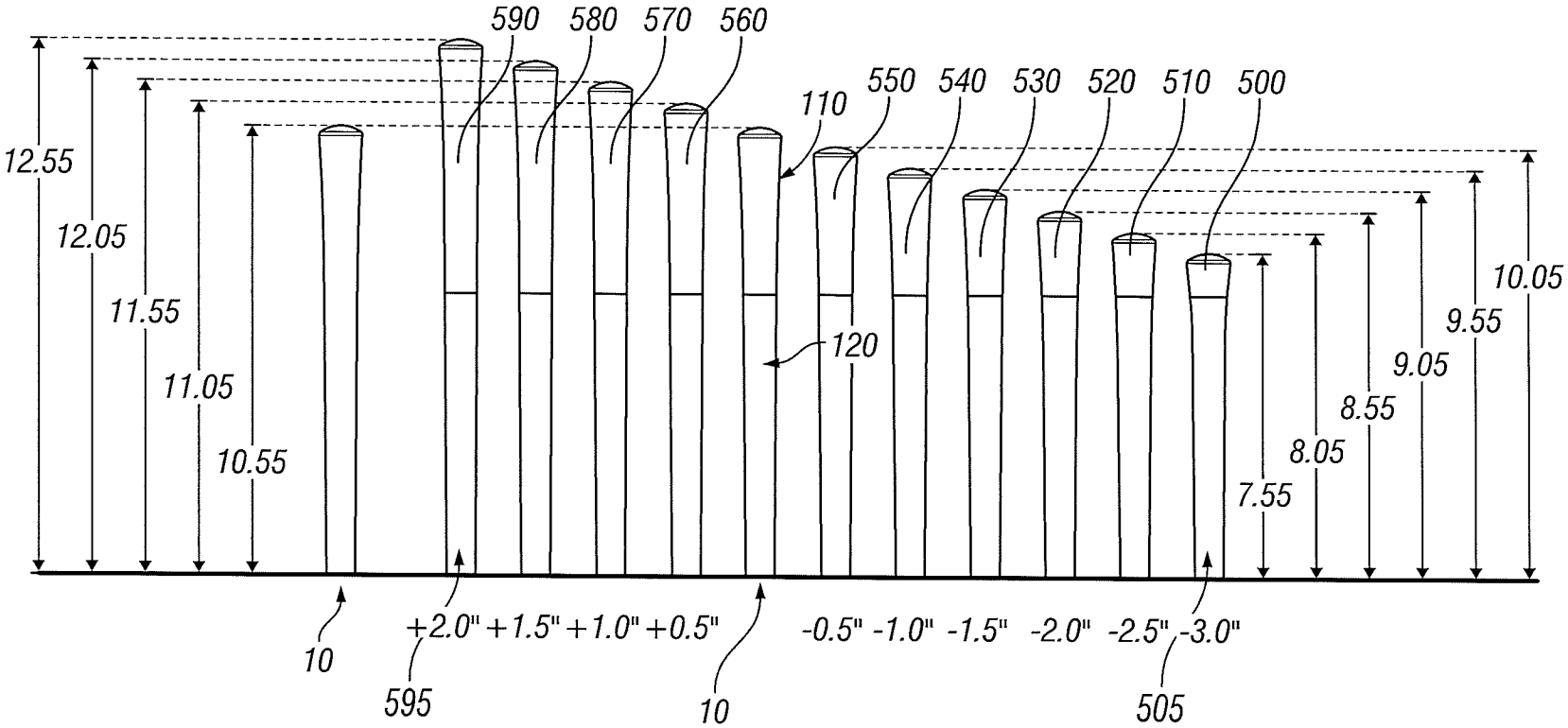
FIG. 10 is a side view of different lengths of upper shaft sections of the variable length shaft of the present invention.
Figure 11:
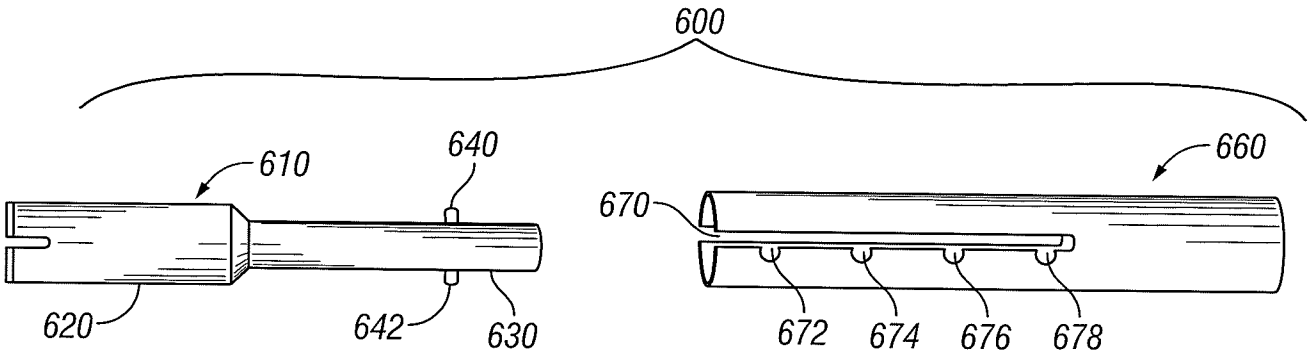
FIG. 11 is a side plan view of an unassembled second embodiment of the present invention.

FIG. 10 shows that the lengths of the lower shaft sections 20 are not altered in the embodiments of the present invention. In other words, a golfer would not exchange the lower shaft piece 120 for a lower shaft piece 120 of a different length. The lower shaft piece 120 of the present invention thus can be permanently affixed to a desired golf club head (not shown). In contrast, according to the first embodiment of the present invention and as disclosed in FIG. 10, the upper shaft section 110 of a normal length club 10 can be easily swapped for other upper shaft sections 500, 510, 520, 530, 540, 550, 560, 570, 580, 590, having different overall lengths. The upper shaft sections 500-590 can also have different weights to allow the golfer to change the overall club weight as desired.

FIG. 10 discloses an assortment of upper shaft sections, each having different lengths so that the total club length of the first and second embodiments can range from a short, 43-inch club 505 to a long, 48-inch club 595. These upper shaft sections can be sold to golfers in kit format along with a lower shaft section 120. As such, if a golfer wishes to increase the length of a shaft, he or she may remove the upper shaft section 110 and replace it with an upper shaft section having a greater length 560, 570, 580, 590. In contrast, if the golfer wishes to decrease the length of the shaft, he or she may remove the upper shaft section 110 and replace it with an upper shaft section having a shorter length 500, 510, 520, 530, 540, 550. The embodiments of this invention thus allow the golfer to increase or decrease the length of a golf club shaft without detaching the lower shaft section 210 from the club head or cutting or damaging any part of the shaft.

A second embodiment of the present invention, which does not require multiple upper shaft or grip pieces having varying lengths, is shown in FIGS. 11 and 12A-12C. A variable length shaft 600 has an upper shaft piece 610 and a lower shaft piece 660. The upper shaft piece is similar in structure to the upper shaft piece 110 shown in FIG. 1, as it has an upper portion 620, a lower portion 630, and one or more pins 640, 642 located on the lower portion 630. The lower shaft piece 660 has at least one notch 670 sized to hold the one or more pins 640, 642. In this embodiment, the at least one notch 670 has more than one side channel 672, 674, 676, 678, within which the pins 640, 642 can fit.

Figure 12:
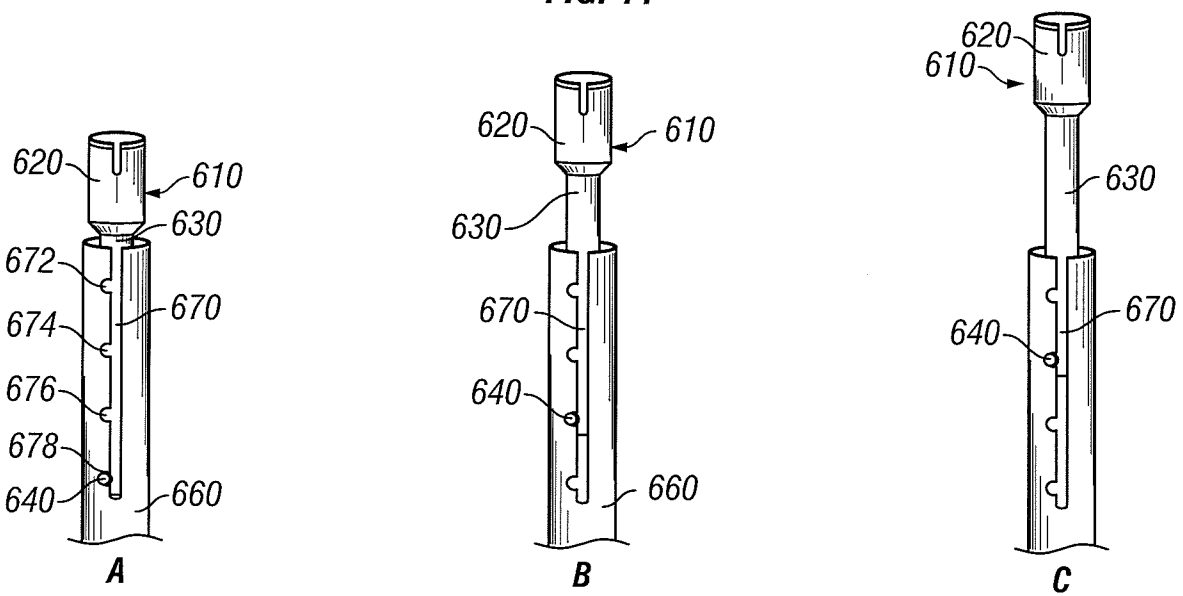
FIGS. 12A, 12B, 12C are side plan views of different assemblies of the embodiment shown in FIG. 11.

To assemble this embodiment, the lower portion 630 of upper shaft piece 610 is inserted in the hollow interior of the lower shaft piece 660 such that the pins 640, 642 slide into the at least one notch 670. When the combination of the lower and upper shaft pieces 610, 660 equals a desired overall shaft length, the upper shaft piece 610 is twisted so that the one or more pins 640, 642 slide into the selected side channel 672, 674, 676, 678, as shown in FIGS. 12A, 12B, and 12C. If a user wishes to change the overall length of the shaft 600, the upper shaft piece 610 is twisted again so that the one or more pins 640, 642 leave the selected side channel 672, 674, 676, 678. A locating clip (not shown) may be used to prevent the pins 640, 642 from leaving the selected side channel 672, 674, 676, 678. Once the user achieves the desired overall shaft 600 length and locks the pins 640, 642 within the selected side channel 672, 674, 676, 678, a grip is sized and fitted to the shaft 600.

The pieces of the variable length shaft and grip of the various embodiments of the present invention may be composed of one or more of any number of materials, including metals, plastics, rubbers, urethanes, and composites. The shaft portions 110, 120 610, 660, the locating clip 400, and the bolts 300, 310 may be composed of titanium, graphite or carbon composite, plastic, magnesium, aluminum, steel, or alloys of such materials, specifically stainless steel 17-7 or titanium 6-4. The shaft portions preferably are composed of graphite. The grip portions 210, 220 preferably are composed of rubber material, and the expandable bushing 180 is preferably composed of urethane. The bolts 300, 300, and the locating clip 400 preferably are composed of a metal material. The pieces of the variable length shaft and grip disclosed herein may also be bonded together with an adhesive to prevent unwanted separation and ensure adequate strength during club use. The variable length shaft and grip disclosed herein may be used with any type of golf club head, including irons, woods, and putters.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A variable length golf club shaft comprising:

at least one upper shaft portion having a first diameter;

a hollow lower shaft portion having a second diameter that is larger than the first diameter;

wherein the lower shaft portion has at least one notch, and wherein the at least one upper shaft portion has at least one pin that fits within the at least one notch; and a locating clip wherein the locating clip comprises a circular portion and at least on prong that fits within the at least one notch.

2. The variable length golf club shaft of claim 1, wherein the locating clip is composed of a metal material.

3. The variable length golf club shaft of claim 1, wherein the locating clip comprises two prongs.

4. The variable length golf club shaft of claim 1, wherein the at least one notch has at least one side channel sized to hold the at least one pin.

5. The variable length golf club shaft of claim 1, wherein the lower shaft portion has two notches.

6. The variable length golf club shaft of claim 5, wherein the two notches each have at least one side channel sized to hold the at least one pin.

7. The variable length golf club shaft of claim 5, wherein the at least one upper shaft portion has two pins.

8. The variable length golf club shaft of claim 1, comprising two or more upper shaft portions having different lengths.

9. The variable length golf club shaft of claim 8, comprising at least one upper grip portion fitted to each of the two or more upper shaft portions having different lengths.

10. The variable length golf club shaft of claim 1, further comprising an upper grip portion and a lower grip portion, wherein the upper grip portion is fitted over at least a portion of the upper shaft portion and the lower grip portion is fitted over at least a portion of the lower shaft portion.

11. The variable length golf club shaft of claim 10, wherein the upper grip portion is affixed to the upper shaft portion with a bolt.

12. The variable length golf club shaft of claim 1, further comprising an expandable bushing affixed to the at least one upper shaft portion.

13. The variable length golf club shaft of claim 12, further comprising a weighting member disposed in the hollow section.

14. The variable length golf club shaft of claim 1, wherein the at least one upper shaft portion has a hollow section.

* * * * *